United States Patent [19]

Maillez

[11] Patent Number: 4,625,607

[45] Date of Patent: Dec. 2, 1986

[54] FOOD SLICER

[76] Inventor: Paul Maillez, 301 cours Emile Zola, Villeurbanne (Rhone), France

[21] Appl. No.: 780,658

[22] Filed: Sep. 26, 1985

[30] Foreign Application Priority Data

Jan. 17, 1985 [FR] France ..... 85 01148

[51] Int. Cl.[4] ..... B26D 3/00

[52] U.S. Cl. ..... 83/466.1; 30/114; 83/394; 83/599; 83/609

[58] Field of Search ..... 83/466.1, 607, 609, 83/599, 394, 395, 396; 30/114

[56] References Cited

U.S. PATENT DOCUMENTS

| | | | |
|---|---|---|---|
| 553,434 | 1/1896 | Sigmund | 83/607 |
| 1,336,726 | 4/1920 | Biwoin | 83/466.1 |
| 1,679,004 | 7/1928 | Pinkel et al. | 83/395 |
| 1,685,245 | 9/1928 | Russo | 83/607 X |
| 2,315,767 | 4/1943 | Brustowsky | 83/466.1 X |
| 2,405,385 | 8/1946 | Wingate | 83/466.1 |
| 4,383,365 | 5/1983 | Metzigian | 30/114 |

*Primary Examiner*—Horace M. Culver
*Attorney, Agent, or Firm*—Karl F. Ross; Herbert Dubno

[57] ABSTRACT

A machine for slicing a piece of a foodstuff has a base having front and rear ends and provided with at least one guide extending longitudinally therebetween, a carriage longitudinally displaceable along the guide on the base and formed with a seat adapted to receive the foodstuff piece and with a plurality of longitudinally extending and upwardly open slots at the seat, and a blade frame pivotal about a horizontal transverse axis at the rear end of the base and provided with a plurality of blades extending radially of the axis. This frame is pivotal between an upper position with the blades extending upward clear of the carriage from the axis and a lower position with the blades extending horizontally longitudinally and received in the slots. A link is connected between the carriage and the blade frame for displacing the carriage longitudinally from the rear base end to the front base end on displacement of the blade frame from the upper to the lower position and vice versa.

7 Claims, 5 Drawing Figures

FOOD SLICER

FIELD OF THE INVENTION

The present invention relates to an apparatus for slicing a piece of foodstuff such as a vegetable, fruit, or egg. More particularly this invention concerns such an apparatus which with one stroke cuts the piece of foodstuff into a plurality of similar slices.

BACKGROUND OF THE INVENTION

A standard food slicer has a base having front and rear ends and provided with at least one guide extending longitudinally therebetween. A carriage is longitudinally displaceable along the guide on the base and formed with a seat adapted to receive the foodstuff piece and with a plurality of longitudinally extending and upwardly open slots at the seat. A plurality of blades extending upward and forward from the rear end of the base are longitudinally aligned with the slots of the carriage. Thus a tomato, for example, to be sliced is dropped onto the carriage which is pushed back toward the blades which cut into it and separate it into slices as they pass through it in the slots.

Such an arrangement works fairly well with fairly stiff but easy-to-cut foodstuffs, such as hard-boiled eggs. When used with something fairly soft or with a somewhat tough skin, such as a ripe tomato, these devices frequently squash the item. Dull blades aggravate this problem.

Another disadvantage of this system is that the cutting edges of the blades are relatively exposed, both during use and when the machine is not being used, presenting a hazard. In addition these blades must be fairly long, so that the likelihood of them bending is considerable.

OBJECTS OF THE INVENTION

It is therefore an object of the present invention to provide an improved food slicer.

Another object is the provision of such a food slicer which overcomes the above-given disadvantages, that is which can accurately cut foodstuffs that are relatively soft and that have relatively hard skins, and whose blades are shielded when not in use.

SUMMARY OF THE INVENTION

A machine for slicing a piece of a foodstuff according to the invention has a base having front and rear ends and provided with at least one guide extending longitudinally therebetween, a carriage longitudinally displaceable along the guide on the base and formed with a seat adapted to receive the foodstuff piece and with a plurality of longitudinally extending and upwardly open slots at the seat, and a blade frame pivotal about a horizontal transverse axis at the rear end of the base and provided with a plurality of blades extending radially of the axis. This frame is pivotal between an upper position with the blades extending upward clear of the carriage from the axis and a lower position with the blades extending horizontally longitudinally and received in the slots. A link is connected between the carriage and the blade frame for displacing the carriage longitudinally from the rear base end to the front base end on displacement of the blade frame from the upper to the lower position and vice versa.

With this system, therefore, the blades have two components of motion—pivotal and sliding—relative to the foodstuff so they can slice even through a thick skin of a relatively soft food item without crushing it. In addition this apparatus can use relatively short blades so that the device is not too bulky, and the blades do not deflect laterally much, giving very straight cuts.

According to another feature of this invention the link has a rear end pivoted on the base and a front end pivoted on the carriage and the carriage is generally L-shaped, having an upright rear portion and a lower horizontal portion, the seat being upwardly concave and formed mainly by the lower horizontal portion. Thus the foodstuff being sliced is effectively cradled so that it does not shift at all during the cutting operation.

In accordance with a further invention feature the blade frame is of rectangular shape, having transverse end members between which the blades are spanned and a front end provided with a handle. In addition the base is provided with an upright mast having an upper end at which the rear end of the link is pivoted. This mast is formed by front and rear arms respectively inclined backward and forward, having upper ends joined at the pivot of the rear end of the link and lower ends fixed to the base and means is provided for disconnecting the carriage from the pivot at the front end of the link. The link extends through the blade frame adjacent the blades. As a result the blades are not dangerously exposed when the machine is open, being surrounded by the blade frame, and when the machine is closed they are completely shielded.

The link according to this invention could also be formed by a crank mechanism, or could be constituted by a cable wound around a pulley carried on the pivot of the blade frame. In any case the motion of the carriage is positively associated with motion of the blade frame so that there are always two different components of motion between the item carried on the carriage and the blades.

DESCRIPTION OF THE DRAWING

The above and other features and advantages will become more readily apparent from the following, reference being made to the accompanying drawing in which.

SPECIFIC DESCRIPTION

Figure 1:
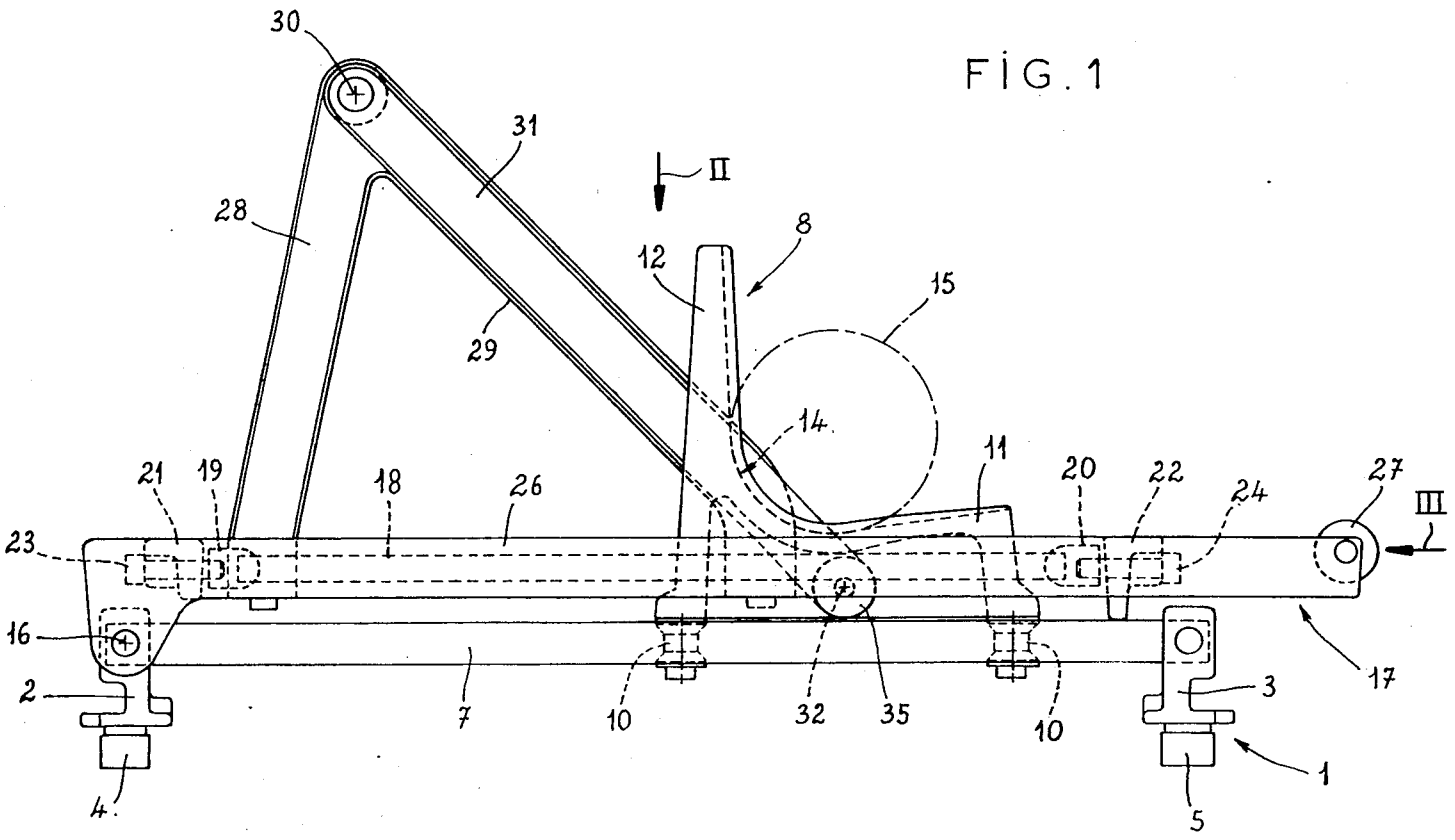
FIG. 1 is a side view of the slicing apparatus with the blade assembly in the lowered final position.
Figure 2:
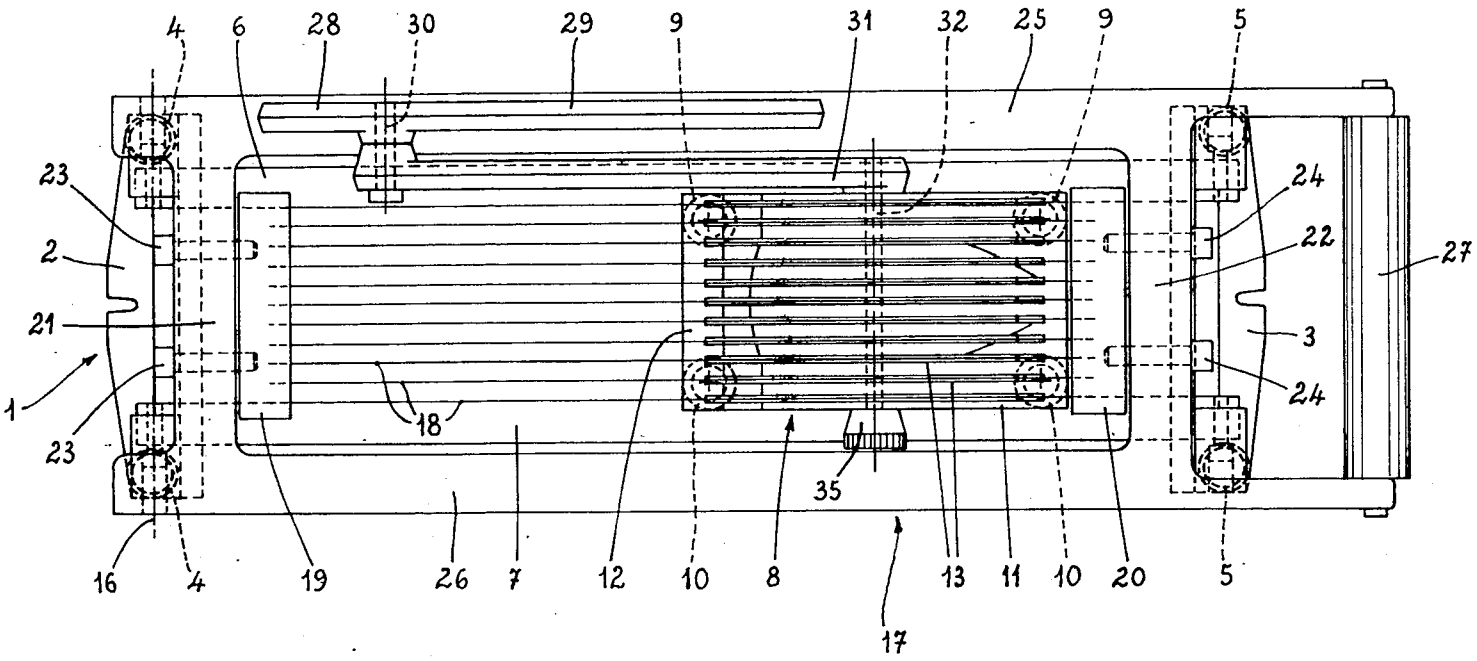
FIGS. 2 and 3 are top and side views of the apparatus as shown by the respective arrows II and III of FIG. 1.
Figure 3:
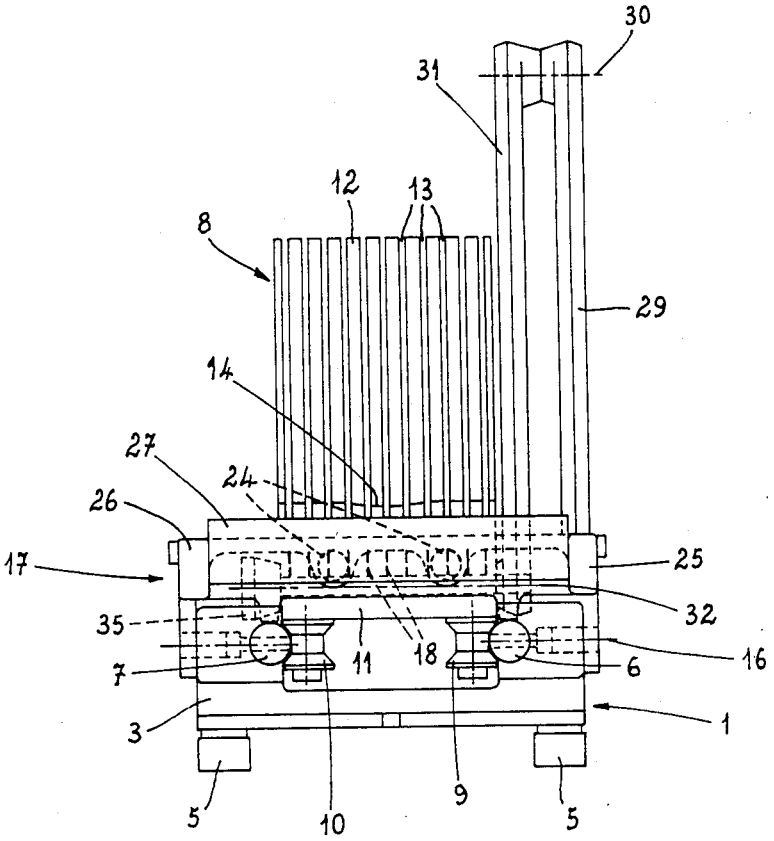

As seen in FIGS. 1 through 3 the slicing machine according to this invention basically comprises a base 1 comprised of horizontal and transverse end members 2 and 3 that stand on the ground via respective feet 4 and 5 and horizontal and longitudinal members or rails 6 and 7 that bridge the end members 2 and 3 and form therewith a stable rectangular frame constituting the base 1. A carriage 8 is supported on the longitudinal rails 6 and 7 by respective hyperboloidal rollers 9 and 10 so that this carriage can move freely longitudinally, that is from left to right as seen in FIGS. 1 and 2, on the base 1. This carriage 8 comprises a generally horizontal lower portion 11 and an upright back portion 12, both formed with vertical, longitudinally extending, and transversely equispaced slots 13 at a spacing that corresponds to the thickness of the slices to be produced by the machine. In addition the carriage 8 is dished somewhat both at the lower and upper portions 11 and 12 to form a seat 14 that is concave upward and longitudinally forward, that is to the right in FIGS. 1 and 2. This seat 14 serves to hold a generally round workpiece 15 such as a fruit, vegetable, or egg.

A generally rectangular frame 17 is pivoted at a horizontal and transverse axis 16 at the rear end member 2 of the base 1 and is comprised of rear and front transverse end members 21 and 22 and longitudinal side members 25 and 26 unitary therewith A plurality of blades 18, which are here constituted as thin metal strips with sharp lower edges but which could also be wires or the like, extend longitudinally parallel to one another with their rear and front ends fixed in respective mounting blocks 19 and 20 secured by bolts 23 and 24 to the rear and front transverse bars 21 and 22 of the frame 17. the bolts 23 and 24 can be tightened to keep the blades 18 taut. The blades 18 are spaced so they can pivot down into the slots 13 and the longitudinal side members 25 and 26 are extended at their front ends where they are bridged by a round handle 27 that projects forward as seen in FIG. 1 well past the base 1.

Two arms 28 and 29 project upward and respectively forward and backward from the one side member 25, with their upper ends united and forming a pivot 30 for the upper end of a link 31 having its lower end pivoted at 32 on the lower portion 11 of the carriage 8. A nut 35 can be removed to disconnect the carriage at this pivot to allow the machine to be disassembled.

Figure 4:
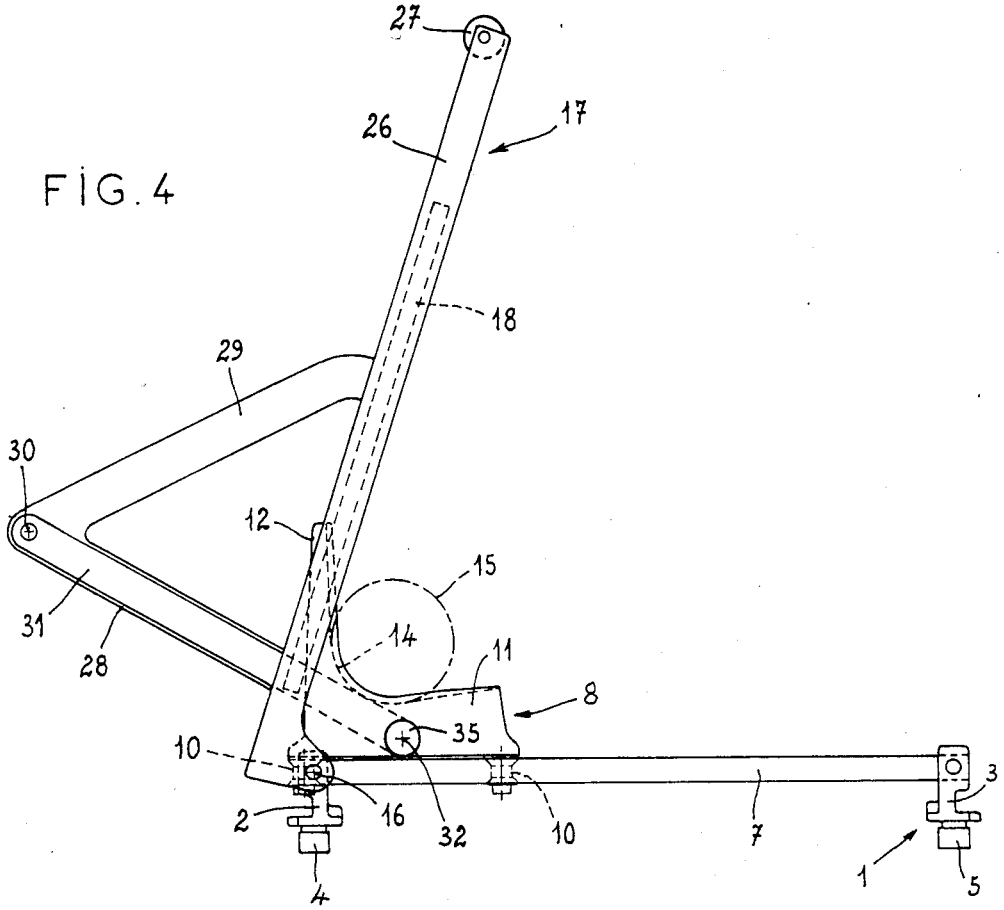
FIGS. 4 and 5 are small-scale side views of the slicing apparatus with the blade assembly respectively in the raised and intermediate positions.

The device described above operates as follows:

To start with the blade frame 17 is lifted as shown in FIG. 4, which action causes the link 31 to pull the carriage 8 to the rear end of the base 1. Then the workpiece 15 is dropped into the seat 14.

Figure 5:
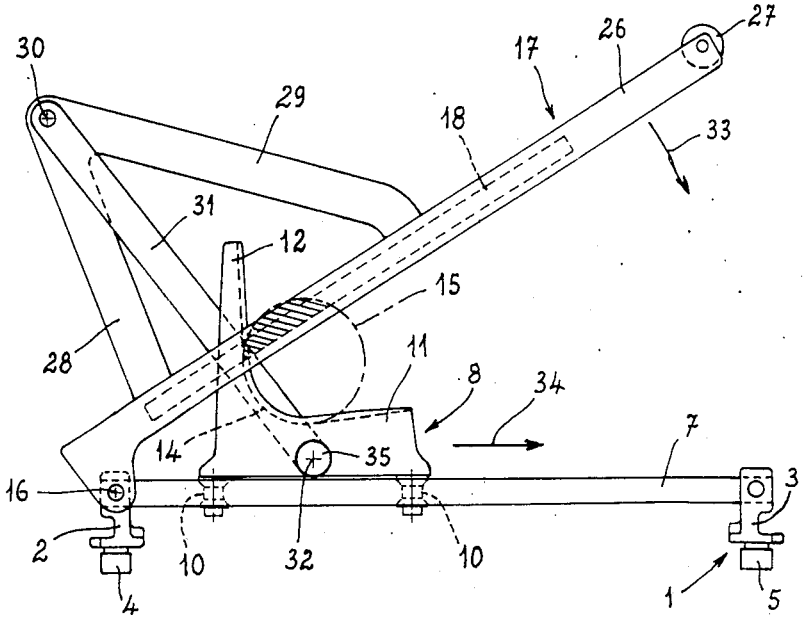

The frame 17 is then pivoted down about its axis 16 as indicated by arrow 33 in FIG. 5, which action causes the link 31 to push the carriage 8 longitudinally forward in the direction of arrow 34 on the base 1. As this occurs, therefore, the blades 18 contact the top of the workpiece 15 and slice through it as it is pulled forward along these blades 18. The cutting action is therefore not merely caused by relative pivoting of the blades 18 and the workpiece 15, but also has a sliding component, ensuring that even a relatively soft workpiece 15 will be sliced without being crushed. The relative sliding action is greater at the start of the cutting stroke, when it is necessary to start the cuts, and is less at the end of the cutting stroke once the blades 18 are well into the workpiece.

By the time the frame assembly 17 has been completely dropped to the end position of FIG. 1, the blades 18 have moved completely through the workpiece 15 which is sliced but all together in the seat 14, so this workpiece 15 can be lifted off easily.

In the fully lowered position it is possible to store the apparatus with the sharp blade edges safely out of harm's way in the device.

I claim:

1. A machine for slicing a piece of a foodstuff, the apparatus comprising:

a base having front and rear ends and provided with at least one guide extending longitudinally therebetween;

a carriage longitudinally displaceable along the guide on the base and formed with a seat adapted to receive the foodstuff piece and with a plurality of longitudinally extending and upwardly open slots at the seat;

a blade frame pivotal about a horizontal transverse axis at the rear end of the base and provided with a plurality of blades extending radially of the axis, the frame being pivotal between an upper position with the blades extending upward clear of the carriage from the axis and a lower position with the blades extending horizontally longitudinally and received in the slots; and means including at least one link between the carriage and the blade frame for displacing the carriage longitudinally from the rear base end to the front base end on displacement of the blade frame from the upper to the lower position and vice versa.

2. The food slicing machine defined in claim 1 wherein the link has a rear end pivoted on the frame and a front end pivoted on the carriage.

3. The food slicing machine defined in claim 2 wherein the carriage is generally L-shaped, having an upright rear portion and a lower horizontal portion, the seat being upwardly concave and formed mainly by the lower horizontal portion.

4. The food slicing machine defined in claim 3 wherein the blade frame is of rectangular shape having transverse end members between which the blades are spanned and a front end provided with a handle.

5. The food slicing machine defined in claim 4 wherein the frame is provided with an upright mast having an upper end at which the rear end of the link is pivoted.

6. The food slicing machine defined in claim 5 wherein the mast is formed by front and rear arms respectively inclined backward and forward, having upper ends joined at the pivot of the rear end of the link and lower ends fixed to the base.

7. The food slicing machine defined in claim 6, further comprising means for disconnecting the carriage from the pivot at the front end of the link.

* * * * *